US008070428B2

(12) United States Patent
Bielek et al.

(10) Patent No.: US 8,070,428 B2
(45) Date of Patent: Dec. 6, 2011

(54) AIRFOIL SHAPE FOR A TURBINE NOZZLE

(75) Inventors: Craig A. Bielek, Simpsonville, SC (US); Donald O. Brock, Greenville, SC (US); Gerald K. Blow, Greer, SC (US)

(73) Assignee: General Electric Company, Schenectady, NY (US)

( * ) Notice: Subject to any disclaimer, the term of this patent is extended or adjusted under 35 U.S.C. 154(b) by 488 days.

(21) Appl. No.: 12/340,853

(22) Filed: Dec. 22, 2008

(65) Prior Publication Data

US 2010/0158678 A1 Jun. 24, 2010

(51) Int. Cl.
*F01D 0/00* (2006.01)

(52) U.S. Cl. ..... 415/191

(58) Field of Classification Search ..... 415/191
See application file for complete search history.

(56) References Cited

U.S. PATENT DOCUMENTS

| | | | | |
|---|---|---|---|---|
| 6,503,054 | B1 | 1/2003 | Bielek et al. | |
| 7,648,334 | B2 * | 1/2010 | Hurst et al. | 415/115 |
| 2010/0158878 | A1 * | 6/2010 | Capela et al. | 424/93.7 |

* cited by examiner

*Primary Examiner* — Matthew Landau
*Assistant Examiner* — Robert Bachner
(74) *Attorney, Agent, or Firm* — Ernest G. Cusick; Frank A. Landgraff

(57) ABSTRACT

An article of manufacture having a nominal profile substantially in accordance with Cartesian coordinate values of X, Y and Z set forth in a table. Wherein X and Y are distances in inches which, when connected by smooth continuing arcs, define airfoil profile sections at each distance Z in inches, the profile sections at the Z distances being joined smoothly with one another to form a complete airfoil shape.

11 Claims, 3 Drawing Sheets

AIRFOIL SHAPE FOR A TURBINE NOZZLE

BACKGROUND OF THE INVENTION

The present invention relates to a turbine nozzle for a gas turbine. In particular, the invention relates to a third stage turbine nozzle airfoil profile.

In a gas turbine, many system requirements should be met at each stage of a gas turbine's flow path section to meet design goals. These design goals include, but are not limited to, overall improved efficiency and airfoil loading capability. For example, and in no way limiting of the invention, a blade of a compressor stator should achieve thermal and mechanical operating requirements for that particular stage. Further, for example, and in no way limiting of the invention, a turbine nozzle airfoil profile should achieve thermal and mechanical operating requirements for that particular stage. Airfoil points have been patented as demonstrated by Bielek et al. in U.S. Pat. No. 6,503,054 B1 on Jan. 7, 2003. The patent identified from 100-150 points per section with each section having a uniform spacing, a stagger angle vs. radius, a throat angle vs. radius and a camber vs. radius. The number of points defined is dependent upon the rate of change of curvature of the section. In other words, for areas with higher curvature more points are used to define that region.

BRIEF DESCRIPTION OF THE INVENTION

In accordance with a preferred embodiment of the present invention, there is provided a unique airfoil profile for the nozzles of a turbine stage, for example the third stage of a gas turbine. The nozzle airfoil profile is defined by unique loci of points to achieve the necessary efficiency whereby improved turbine performance is obtained. These unique loci of points define the nominal airfoil profile and are identified by the X, Y and Z Cartesian coordinates of Table 1, which follows. The points for the coordinate values shown in Table 1 are for a cold, in other words, room temperature, profile at various planar cross-sections of the nozzle airfoil along its length. The X and Y coordinates are given in distance dimensions, e.g., units of inches, and are joined smoothly at each Z location to form a smooth continuous airfoil cross-section. The Z coordinates are given in length dimension of inches along a nozzle-stacking axis coincident with a radius from the axis of turbine rotation. Each defined cross-section is then joined smoothly with adjacent cross-sections to form the complete airfoil shape.

It will be appreciated that as each nozzle airfoil heats up in use, the profile will change as a result of stress and temperature. Thus, the cold or room temperature profile is given by the X, Y and Z coordinates for manufacturing purposes. Since the manufactured nozzle airfoil profile may be different from the nominal airfoil profile given by the following table, a distance of plus or minus 0.100 inches from the nominal profile in a direction normal to any surface location along the nominal defines the profile envelope for this nozzle airfoil. The envelope includes any possible airfoil surface coating process. The design is robust to this variation without impairment of the mechanical and aerodynamic functions.

It will also be appreciated that the airfoil can be scaled up or scaled down geometrically for introduction into similar turbine designs. Consequently, the X, Y, and Z coordinates in inches of the nominal airfoil profile given below are a function of the same constant or number. That is, the X and Y and optionally the Z coordinate values in inches may be multiplied or divided by the same constant or number to provide a scaled up or scaled down version of the nozzle airfoil profile while retaining the airfoil section shape.

In one aspect of the present invention, there is provided a turbine nozzle having an airfoil shape in an envelope within ±0.100 inches in a direction normal to any airfoil surface location wherein the airfoil has a nominal profile substantially in accordance with Cartesian coordinate values of X, Y and Z set forth in Table 1. X and Y are distances in inches defining the airfoil profile at each distance Z, the profiles at the Z distances being joined smoothly with one another to form a complete airfoil shape.

In another aspect of the present invention, there is provided a turbine nozzle having an uncoated nominal airfoil profile substantially in accordance with Cartesian coordinate values of X, Y and Z set forth in Table 1. Wherein X and Y are distances in inches defining the airfoil profile at each distance Z, the profiles at the Z distances being joined smoothly with one another to form a complete airfoil shape, the X and Y distances being scalable as a function of the same constant or number to provide a scaled-up or scaled-down nozzle airfoil.

In a further aspect of the present invention, there is provided a turbine comprising a turbine nozzle arrangement having a plurality of nozzles, each of said nozzles having an airfoil shape in an envelope within ±0.100 inches in a direction normal to any airfoil surface location wherein the airfoil has a nominal profile substantially in accordance with Cartesian coordinate values of X, Y and Z set forth in Table 1. wherein X and Y are distances in inches defining the airfoil profile at each distance Z, the profiles at the Z distances being joined smoothly with one another to form a complete airfoil shape.

In a further aspect of the present invention, there is provided a turbine comprising a turbine nozzle arrangement having a plurality of nozzles, each of said nozzles having an uncoated nominal airfoil profile substantially in accordance with Cartesian coordinate values of X, Y and Z set forth in Table 1 wherein X and Y are distances in inches defining the airfoil profile at each distance Z, the profiles at the Z distances being joined smoothly with one another to form a complete airfoil shape, the X and Y distances being scalable as a function of the same constant or number to provide a scaled-up or scaled-down nozzle airfoil. These and other aspects, advantages and salient features of the invention will become apparent from the following detailed description, which, when taken in conjunction with the annexed drawings, where like parts are designated by like reference characters throughout the drawings, disclose embodiments of the invention.

DETAILED DESCRIPTION OF THE INVENTION

Figure 1:
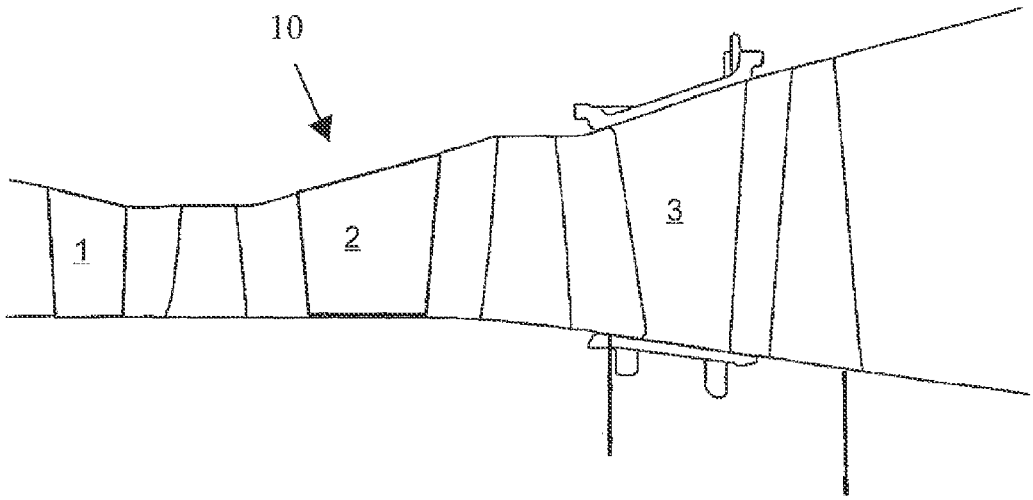
FIG. 1 is a schematic illustration of a turbine having a turbine nozzle arrangement employing the nozzles and nozzle airfoil, as embodied by the invention.

Referring now to FIG. 1, there is illustrated a portion of a turbine 10 in which a, such as but not limited to, a third stage turbine nozzle, having an airfoil profile, as defined herein, may be utilized. The turbine 10 includes first, second, and third stage nozzle arrangements 1, 2, and 3 having nozzles in conjunction with the respective buckets of the various stages of the rotor. It will be appreciated that a three-stage turbine is illustrated, as an exemplary turbine, which in no means is intended to limit the invention. For ease of discussion, a third stage will be discussed herein, but as a non-limiting configuration. Any stage for the turbine nozzle is within the scope of the invention.

The exemplary third stage comprises a triplet airfoil nozzle arrangement and a rotor assembly whereby the nozzles are upstream of the buckets. It will be appreciated that a plurality of nozzles are spaced circumferentially, one from the other, about the third stage nozzle arrangement and in this instance there are twenty (20) nozzles mounted on the third stage nozzle arrangement.

Figure 2:
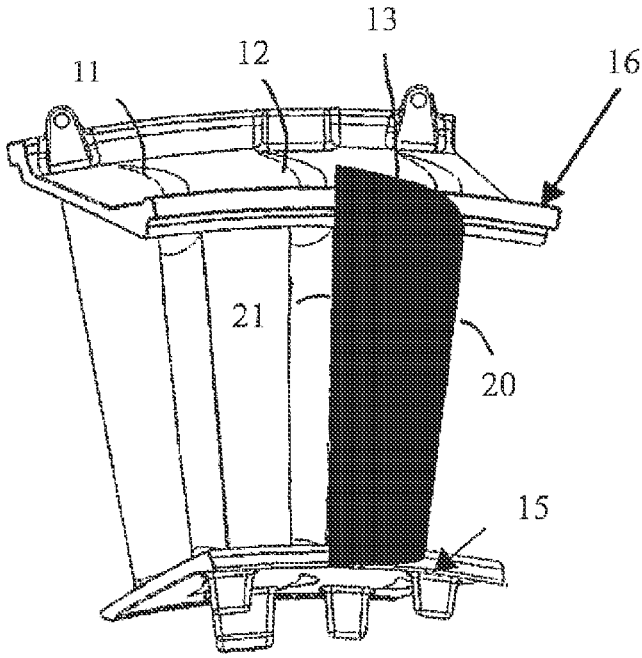
FIG. 2 is a frontal view of a turbine nozzle including an airfoil and sidewalls, as embodied by the invention.
Figure 3:
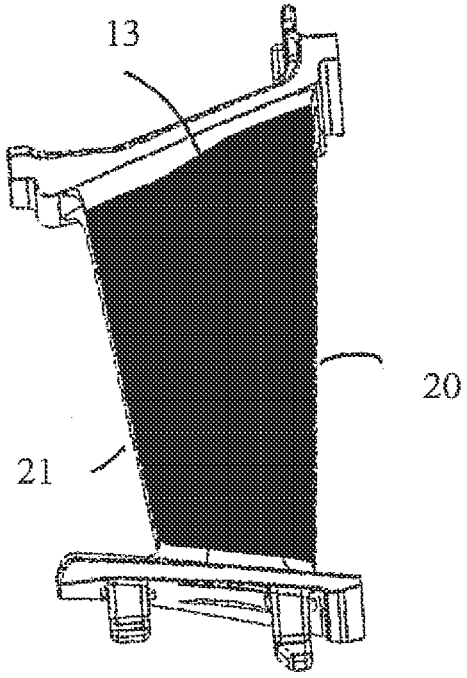
FIG. 3 is a suction side view of a turbine nozzle including an airfoil and sidewalls, as embodied by the invention.
Figure 4:
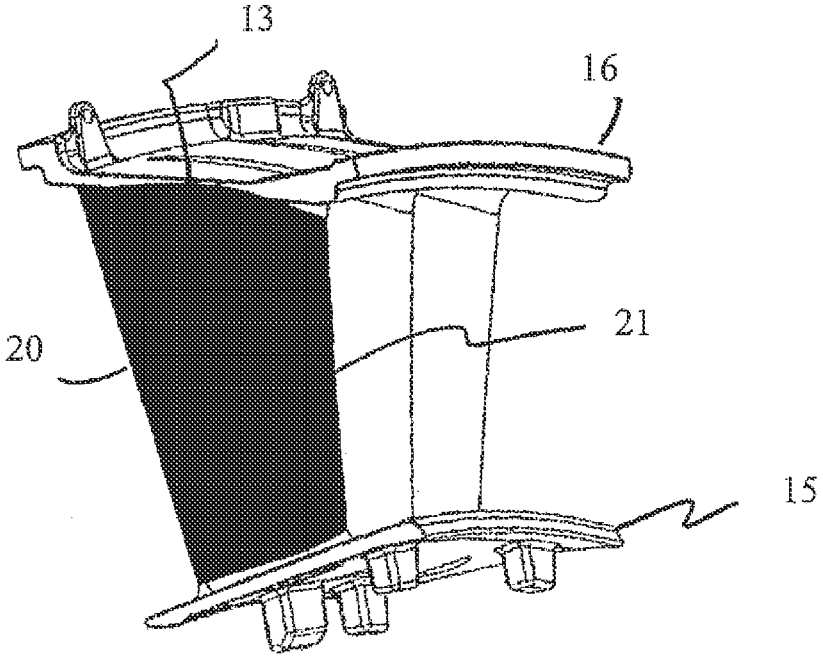
FIG. 4 is a pressure side isometric view of a turbine nozzle including an airfoil and sidewalls, as embodied by the invention.

Referring now to FIGS. 2, 3, and 4, there is illustrated a turbine nozzle constructed in accordance with the present invention including three airfoils 11, 12, 13 mounted between an inner 15 and outer 16 sidewall. The nozzles 11, 12, 13 are suitably mounted on the surrounding hardware by suitable means (not illustrated). The airfoils 11, 12, 13 and sidewalls 15, 16 are collectively referred to as a nozzle. The airfoils have a profile including a 2-dimensional shape with suction 26 and pressure 25 sides, respectively, as well as a leading edge 20 and trailing edge 21.

Figure 5:
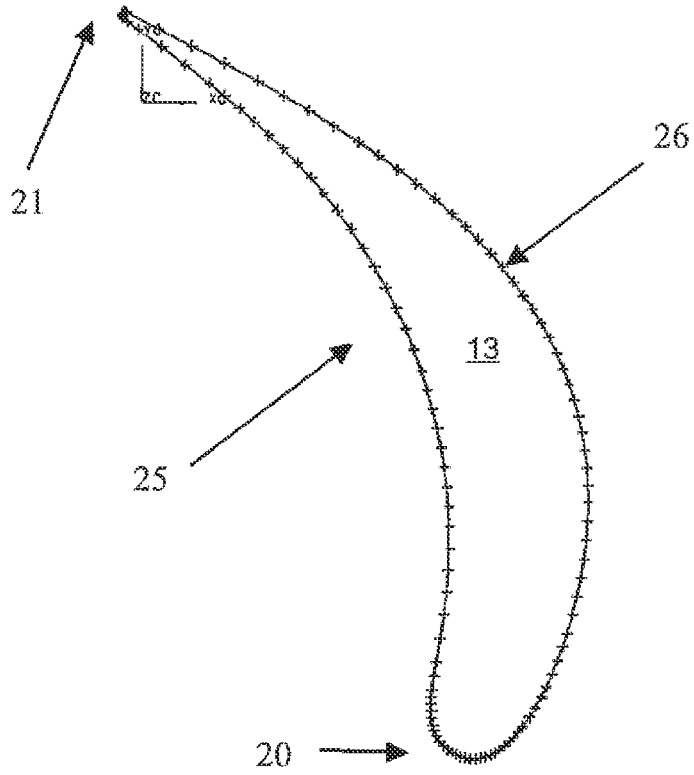
FIG. 5 is a sectional illustration through the airfoil with points illustrated thereon, where the point coordinates are with respect to the coordinate system orientation illustrated therein, as embodied by the invention.

Referring now to FIG. 5, a section through an airfoil is shown with respective callouts for pressure side 25, suction side 26, leading edge 20, and trailing edge 21 is illustrated. FIG. 5 also illustrates a typical distribution of points for a section shown in Table 1. The points are defined such that more points represent the areas in which the rate of change of the curvature is greater as seen at the leading and trailing edge.

A Cartesian coordinate system of X, Y and Z values given in Table 1 define profiles of nozzle airfoils. The coordinate values for the X, Y, and Z coordinates are set forth in inches in Table 1, although other units of dimensions may be used. The Cartesian coordinate system has orthogonally-related X, Y and Z-axes with the Z axis extending perpendicular to a plane normal to a plane containing the X and Y values. The Z distance commences at 0 at the turbine centerline. The Y-axis lies parallel to the turbine rotor centerline, i.e., the rotary axis.

By defining X and Y coordinate values at selected locations in a Z direction normal to the X, Y plane, and the profile of the airfoil can be ascertained. By connecting the X and Y values with smooth continuing arcs, each profile section at each distance Z is fixed. The surface profiles of the various surface locations between the distances Z are determined by smoothly connecting the adjacent cross-sections to one another to form the airfoil surface. These values represent the airfoil profiles at ambient, non-operating or non-hot conditions and are for an uncoated airfoil. The sign convention assigns a positive value to Z values and positive and negative values for the X and Y coordinates as typically used in Cartesian coordinate systems.

The Table 1 values are generated and shown to three decimal places for determining the profile of the airfoil. There are typical manufacturing tolerances, which may be accounted for in the airfoil profile. Accordingly, the values for the profile given in Table 1 are for a nominal airfoil. It will therefore be appreciated that ±typical manufacturing tolerances are additive to the X and Y values given in Table 1 below. Accordingly, a distance of ±0.100 inches in a direction normal to any surface location along the airfoil profile defines an airfoil profile envelope for this particular nozzle airfoil design and turbine.

TABLE 1

The coordinate values given below provide the preferred nominal profile envelope.

| X | Y | Z |
|---|---|---|
| 0.184 | 0.804 | 51.017 |
| −0.245 | 0.936 | 51.017 |
| 1.861 | −0.073 | 51.017 |
| −0.228 | 0.985 | 51.017 |
| 3.043 | −0.864 | 51.017 |
| 2.473 | −1.578 | 51.017 |
| 1.74 | −0.65 | 51.017 |
| 0.927 | 0.081 | 51.017 |
| −0.172 | 0.879 | 51.017 |
| 0.927 | 0.437 | 51.017 |
| −0.247 | 0.962 | 51.017 |
| 2.411 | −0.414 | 51.017 |
| 2.837 | −2.238 | 51.017 |
| −0.188 | 0.986 | 51.017 |
| 3.443 | −1.194 | 51.017 |
| 2.188 | −1.172 | 51.017 |
| 1.427 | −0.344 | 51.017 |
| 0.487 | 0.414 | 51.017 |
| −0.236 | 0.924 | 51.017 |
| 1.579 | 0.089 | 51.017 |
| −0.236 | 0.979 | 51.017 |
| 2.836 | −0.708 | 51.017 |
| 2.602 | −1.79 | 51.017 |
| 3.741 | −1.476 | 51.017 |
| 1.89 | −0.811 | 51.017 |
| 1.097 | −0.057 | 51.017 |
| −0.057 | 0.8 | 51.017 |
| 0.556 | 0.622 | 51.017 |
| −0.249 | 0.952 | 51.017 |
| 2.138 | −0.24 | 51.017 |
| −0.208 | 0.99 | 51.017 |
| 3.246 | −1.025 | 51.017 |
| 2.335 | −1.372 | 51.017 |
| 1.586 | −0.494 | 51.017 |
| 0.754 | 0.215 | 51.017 |
| −0.223 | 0.914 | 51.017 |
| −0.243 | 0.971 | 51.017 |
| 1.294 | 0.245 | 51.017 |
| 2.626 | −0.559 | 51.017 |
| 2.724 | −2.012 | 51.017 |
| 3.594 | −1.333 | 51.017 |
| 2.034 | −0.978 | 51.017 |
| 1.264 | −0.199 | 51.017 |
| 0.217 | 0.609 | 51.017 |
| 3.347 | −3.781 | 51.017 |
| 3.035 | −2.699 | 51.017 |
| 3.884 | −1.623 | 51.017 |
| 4.466 | −2.388 | 51.017 |
| 4.846 | −3.229 | 51.017 |
| 3.437 | −4.438 | 51.017 |
| 3.248 | −3.353 | 51.017 |
| 4.15 | −1.934 | 51.017 |
| 4.643 | −2.715 | 51.017 |
| 3.385 | −3.998 | 51.017 |
| 3.121 | −2.933 | 51.017 |
| 4.367 | −2.232 | 51.017 |
| 4.787 | −3.055 | 51.017 |
| 3.45 | −4.658 | 51.017 |
| 3.301 | −3.566 | 51.017 |
| 2.941 | −2.467 | 51.017 |
| 4.02 | −1.776 | 51.017 |
| 4.558 | −2.549 | 51.017 |
| 4.899 | −3.414 | 51.017 |
| 3.415 | −4.218 | 51.017 |
| 3.188 | −3.142 | 51.017 |
| 4.261 | −2.081 | 51.017 |
| 4.72 | −2.884 | 51.017 |
| 4.975 | −3.792 | 51.017 |
| 3.782 | −7.259 | 51.017 |
| 5.002 | −4.797 | 51.017 |

TABLE 1-continued

The coordinate values given below provide the preferred nominal profile envelope.

| X | Y | Z |
|---|---|---|
| 3.515 | −7.19 | 51.017 |
| 4.802 | −5.835 | 51.017 |
| 3.316 | −6.945 | 51.017 |
| 4.517 | −6.558 | 51.017 |
| 3.279 | −6.568 | 51.017 |
| 4.221 | −7.005 | 51.017 |
| 3.405 | −5.638 | 51.017 |
| 4.858 | −5.632 | 51.017 |
| 3.952 | −7.215 | 51.017 |
| 3.671 | −7.251 | 51.017 |
| 4.947 | −5.217 | 51.017 |
| 3.419 | −7.115 | 51.017 |
| 4.698 | −6.142 | 51.017 |
| 3.284 | −6.803 | 51.017 |
| 4.388 | −6.782 | 51.017 |
| 3.303 | −6.337 | 51.017 |
| 4.114 | −7.11 | 51.017 |
| 3.447 | −5.149 | 51.017 |
| 4.942 | −3.602 | 51.017 |
| 3.84 | −7.252 | 51.017 |
| 5.014 | −4.18 | 51.017 |
| 5.015 | −4.586 | 51.017 |
| 3.565 | −7.216 | 51.017 |
| 3.342 | −7.006 | 51.017 |
| 4.573 | −6.442 | 51.017 |
| 3.276 | −6.646 | 51.017 |
| 4.269 | −6.948 | 51.017 |
| 3.367 | −5.911 | 51.017 |
| 4.005 | −7.187 | 51.017 |
| 4.999 | −3.986 | 51.017 |
| 3.726 | −7.258 | 51.017 |
| 4.979 | −5.007 | 51.017 |
| 3.469 | −7.159 | 51.017 |
| 4.753 | −5.989 | 51.017 |
| 3.297 | −6.88 | 51.017 |
| 4.455 | −6.672 | 51.017 |
| 3.285 | −6.49 | 51.017 |
| 4.169 | −7.059 | 51.017 |
| 3.431 | −5.393 | 51.017 |
| 3.897 | −7.236 | 51.017 |
| 5.019 | −4.374 | 51.017 |
| 3.617 | −7.236 | 51.017 |
| 4.907 | −5.425 | 51.017 |
| 3.376 | −7.064 | 51.017 |
| 4.639 | −6.293 | 51.017 |
| 3.277 | −6.725 | 51.017 |
| 4.315 | −6.888 | 51.017 |
| 3.325 | −6.184 | 51.017 |
| 4.055 | −7.156 | 51.017 |
| 3.454 | −4.903 | 51.017 |
| 0.918 | −0.008 | 49.687 |
| −0.159 | 0.775 | 49.687 |
| 0.892 | 0.35 | 49.687 |
| −0.242 | 0.856 | 49.687 |
| 2.332 | −0.473 | 49.687 |
| −0.182 | 0.888 | 49.687 |
| 3.335 | −1.218 | 49.687 |
| 2.264 | −1.388 | 49.687 |
| 1.47 | −0.484 | 49.687 |
| 0.468 | 0.334 | 49.687 |
| −0.221 | 0.818 | 49.687 |
| 1.522 | 0.012 | 49.687 |
| −0.236 | 0.874 | 49.687 |
| 1.972 | −1.012 | 49.687 |
| 2.747 | −0.756 | 49.687 |
| 2.643 | −2 | 49.687 |
| 3.624 | −1.482 | 49.687 |
| 1.106 | −0.162 | 49.687 |
| −0.059 | 0.707 | 49.687 |
| 0.536 | 0.531 | 49.687 |
| −0.24 | 0.841 | 49.687 |
| 2.066 | −0.305 | 49.687 |
| −0.201 | 0.893 | 49.687 |
| 3.144 | −1.058 | 49.687 |
| 2.399 | −1.585 | 49.687 |

TABLE 1-continued

The coordinate values given below provide the preferred nominal profile envelope.

| X | Y | Z |
|---|---|---|
| 1.644 | −0.654 | 49.687 |
| 0.726 | 0.141 | 49.687 |
| −0.208 | 0.809 | 49.687 |
| 1.247 | 0.164 | 49.687 |
| −0.24 | 0.865 | 49.687 |
| 2.541 | −0.612 | 49.687 |
| 2.753 | −2.216 | 49.687 |
| 3.482 | −1.348 | 49.687 |
| 2.122 | −1.197 | 49.687 |
| 1.291 | −0.321 | 49.687 |
| 0.206 | 0.522 | 49.687 |
| 0.177 | 0.71 | 49.687 |
| −0.233 | 0.828 | 49.687 |
| 1.796 | −0.144 | 49.687 |
| −0.221 | 0.888 | 49.687 |
| 2.948 | −0.904 | 49.687 |
| 2.524 | −1.788 | 49.687 |
| 1.811 | −0.829 | 49.687 |
| 4.341 | −2.355 | 49.687 |
| 4.727 | −3.164 | 49.687 |
| 3.343 | −4.543 | 49.687 |
| 3.2 | −3.495 | 49.687 |
| 2.853 | −2.436 | 49.687 |
| 4.023 | −1.917 | 49.687 |
| 4.519 | −2.667 | 49.687 |
| 4.826 | −3.53 | 49.687 |
| 3.31 | −4.122 | 49.687 |
| 3.091 | −3.086 | 49.687 |
| 4.135 | −2.058 | 49.687 |
| 4.241 | −2.204 | 49.687 |
| 4.666 | −2.994 | 49.687 |
| 3.348 | −4.779 | 49.687 |
| 3.244 | −3.703 | 49.687 |
| 2.944 | −2.658 | 49.687 |
| 3.895 | −1.766 | 49.687 |
| 4.434 | −2.509 | 49.687 |
| 4.782 | −3.346 | 49.687 |
| 3.331 | −4.332 | 49.687 |
| 3.149 | −3.289 | 49.687 |
| 4.596 | −2.829 | 49.687 |
| 3.281 | −3.912 | 49.687 |
| 3.027 | −2.885 | 49.687 |
| 3.762 | −1.622 | 49.687 |
| 4.364 | −6.391 | 49.687 |
| 4.032 | −6.836 | 49.687 |
| 3.271 | −5.665 | 49.687 |
| 3.741 | −7.032 | 49.687 |
| 4.9 | −4.088 | 49.687 |
| 3.47 | −7.037 | 49.687 |
| 4.829 | −5.097 | 49.687 |
| 3.246 | −6.89 | 49.687 |
| 4.559 | −5.992 | 49.687 |
| 3.147 | −6.618 | 49.687 |
| 4.229 | −6.601 | 49.687 |
| 3.183 | −6.165 | 49.687 |
| 3.893 | −6.952 | 49.687 |
| 3.325 | −5.252 | 49.687 |
| 3.63 | −7.057 | 49.687 |
| 4.902 | −4.483 | 49.687 |
| 3.37 | −6.993 | 49.687 |
| 4.733 | −5.497 | 49.687 |
| 3.190 | −6.797 | 49.687 |
| 4.424 | −6.281 | 49.687 |
| 3.145 | −6.465 | 49.687 |
| 4.095 | −6.770 | 49.687 |
| 3.241 | −5.841 | 49.687 |
| 3.794 | −7.010 | 49.687 |
| 4.885 | −3.901 | 49.687 |
| 3.522 | −7.051 | 49.687 |
| 4.863 | −4.894 | 49.687 |
| 3.283 | −6.930 | 49.687 |
| 4.618 | −5.844 | 49.687 |
| 3.157 | −6.694 | 49.687 |
| 4.299 | −6.498 | 49.687 |
| 3.160 | −6.313 | 49.687 |

TABLE 1-continued

The coordinate values given below provide the preferred nominal profile envelope.

| X | Y | Z |
|---|---|---|
| 3.965 | −6.897 | 49.687 |
| 3.298 | −5.489 | 49.687 |
| 3.686 | −7.048 | 49.687 |
| 4.906 | −4.276 | 49.687 |
| 3.419 | −7.017 | 49.687 |
| 3.576 | −7.058 | 49.687 |
| 4.785 | −5.298 | 49.687 |
| 3.215 | −6.846 | 49.687 |
| 4.495 | −6.138 | 49.687 |
| 3.143 | −6.542 | 49.687 |
| 4.154 | −6.701 | 49.687 |
| 3.209 | −6.017 | 49.687 |
| 3.844 | −6.983 | 49.687 |
| 3.342 | −5.015 | 49.687 |
| 4.861 | −3.715 | 49.687 |
| 4.672 | −5.694 | 49.687 |
| 4.887 | −4.689 | 49.687 |
| 3.325 | −6.964 | 49.687 |
| 3.171 | −6.746 | 49.687 |
| 3.151 | −6.389 | 49.687 |
| 2.712 | −2.302 | 48.357 |
| −0.175 | 0.79 | 48.357 |
| 3.244 | −1.255 | 48.357 |
| 2.186 | −1.404 | 48.357 |
| 1.413 | −0.536 | 48.357 |
| 0.446 | 0.255 | 48.357 |
| −0.219 | 0.722 | 48.357 |
| 1.472 | −0.067 | 48.357 |
| −0.224 | 0.783 | 48.357 |
| 2.664 | −0.807 | 48.357 |
| 2.538 | −1.957 | 48.357 |
| 3.529 | −1.513 | 48.357 |
| 1.901 | −1.043 | 48.357 |
| 1.062 | −0.225 | 48.357 |
| −0.062 | 0.615 | 48.357 |
| 0.517 | 0.44 | 48.357 |
| −0.235 | 0.746 | 48.357 |
| 1.998 | −0.373 | 48.357 |
| −0.194 | 0.795 | 48.357 |
| 3.055 | −1.1 | 48.357 |
| 1.582 | −0.699 | 48.357 |
| 0.695 | 0.069 | 48.357 |
| −0.207 | 0.714 | 48.357 |
| 1.205 | 0.08 | 48.357 |
| −0.232 | 0.773 | 48.357 |
| −0.236 | 0.76 | 48.357 |
| 2.462 | −0.668 | 48.357 |
| 2.628 | −2.128 | 48.357 |
| 3.389 | −1.382 | 48.357 |
| 2.047 | −1.221 | 48.357 |
| 1.24 | −0.378 | 48.357 |
| 2.318 | −1.594 | 48.357 |
| 0.193 | 0.437 | 48.357 |
| 0.171 | 0.616 | 48.357 |
| −0.229 | 0.733 | 48.357 |
| 1.737 | −0.218 | 48.357 |
| −0.213 | 0.791 | 48.357 |
| 2.862 | −0.951 | 48.357 |
| 2.441 | −1.788 | 48.357 |
| −0.158 | 0.681 | 48.357 |
| 1.744 | −0.868 | 48.357 |
| 0.88 | −0.076 | 48.357 |
| 0.862 | 0.262 | 48.357 |
| 2.257 | −0.534 | 48.357 |
| 3.922 | −1.934 | 48.357 |
| 4.428 | −2.705 | 48.357 |
| 4.696 | −3.48 | 48.357 |
| 4.729 | −3.659 | 48.357 |
| 4.156 | −2.244 | 48.357 |
| 4.55 | −2.984 | 48.357 |
| 3.796 | −1.789 | 48.357 |
| 4.358 | −2.571 | 48.357 |
| 4.654 | −3.303 | 48.357 |
| 4.043 | −2.087 | 48.357 |
| 4.492 | −2.843 | 48.357 |

TABLE 1-continued

The coordinate values given below provide the preferred nominal profile envelope.

| X | Y | Z |
|---|---|---|
| 3.665 | −1.648 | 48.357 |
| 4.261 | −2.405 | 48.357 |
| 4.601 | −3.128 | 48.357 |
| 4.461 | −5.702 | 48.357 |
| 4.762 | −4.374 | 48.357 |
| 4.62 | −5.228 | 48.357 |
| 4.336 | −5.982 | 48.357 |
| 4.751 | −3.838 | 48.357 |
| 4.727 | −4.721 | 48.357 |
| 4.516 | −5.558 | 48.357 |
| 4.206 | −6.223 | 48.357 |
| 4.767 | −4.2 | 48.357 |
| 4.662 | −5.061 | 48.357 |
| 4.402 | −5.843 | 48.357 |
| 4.748 | −4.548 | 48.357 |
| 4.571 | −5.394 | 48.357 |
| 4.266 | −6.118 | 48.357 |
| 4.764 | −4.018 | 48.357 |
| 4.698 | −4.891 | 48.357 |
| 3.177 | −3.975 | 48.357 |
| 2.925 | −2.838 | 48.357 |
| 3.211 | −4.665 | 48.357 |
| 3.105 | −3.513 | 48.357 |
| 2.789 | −2.478 | 48.357 |
| 3.198 | −4.207 | 48.357 |
| 2.994 | −3.06 | 48.357 |
| 3.203 | −4.891 | 48.357 |
| 3.146 | −3.744 | 48.357 |
| 2.86 | −2.657 | 48.357 |
| 3.209 | −4.438 | 48.357 |
| 3.054 | −3.285 | 48.357 |
| 3.038 | −6.504 | 48.357 |
| 3.123 | −5.599 | 48.357 |
| 4.141 | −6.326 | 48.357 |
| 3.038 | −6.137 | 48.357 |
| 3.813 | −6.706 | 48.357 |
| 3.186 | −5.118 | 48.357 |
| 3.543 | −6.848 | 48.357 |
| 3.286 | −6.819 | 48.357 |
| 3.091 | −6.65 | 48.357 |
| 3.024 | −6.358 | 48.357 |
| 3.998 | −6.52 | 48.357 |
| 3.081 | −5.853 | 48.357 |
| 3.696 | −6.787 | 48.357 |
| 3.437 | −6.857 | 48.357 |
| 3.196 | −6.766 | 48.357 |
| 3.05 | −6.555 | 48.357 |
| 3.879 | −6.648 | 48.357 |
| 3.03 | −6.21 | 48.357 |
| 3.16 | −5.345 | 48.357 |
| 3.596 | −6.833 | 48.357 |
| 3.335 | −6.838 | 48.357 |
| 3.121 | −6.693 | 48.357 |
| 3.027 | −6.431 | 48.357 |
| 4.072 | −6.425 | 48.357 |
| 3.058 | −5.995 | 48.357 |
| 3.743 | −6.758 | 48.357 |
| 3.489 | −6.856 | 48.357 |
| 3.24 | −6.795 | 48.357 |
| 3.068 | −6.604 | 48.357 |
| 3.025 | −6.284 | 48.357 |
| 3.94 | −6.586 | 48.357 |
| 3.647 | −6.813 | 48.357 |
| 3.385 | −6.851 | 48.357 |
| 3.156 | −6.732 | 48.357 |
| −0.204 | 0.617 | 47.027 |
| 1.297 | −0.077 | 47.027 |
| −0.221 | 0.682 | 47.027 |
| 2.541 | −0.83 | 47.027 |
| 2.46 | −1.979 | 47.027 |
| 3.375 | −1.488 | 47.027 |
| 1.843 | −1.097 | 47.027 |
| 1.029 | −0.299 | 47.027 |
| −0.064 | 0.521 | 47.027 |
| 0.42 | 0.39 | 47.027 |

TABLE 1-continued

The coordinate values given below provide the preferred nominal profile envelope.

| X | Y | Z |
|---|---|---|
| −0.225 | 0.637 | 47.027 |
| 1.871 | −0.404 | 47.027 |
| −0.187 | 0.697 | 47.027 |
| 2.916 | −1.103 | 47.027 |
| 2.246 | −1.627 | 47.027 |
| 1.533 | −0.763 | 47.027 |
| 0.673 | −0.012 | 47.027 |
| −0.181 | 0.602 | 47.027 |
| 1.006 | 0.081 | 47.027 |
| −0.229 | 0.665 | 47.027 |
| 2.348 | −0.701 | 47.027 |
| 2.549 | −2.148 | 47.027 |
| 3.238 | −1.366 | 47.027 |
| 1.985 | −1.268 | 47.027 |
| 1.37 | −0.603 | 47.027 |
| 1.201 | −0.449 | 47.027 |
| 0.185 | 0.347 | 47.027 |
| 0.126 | 0.542 | 47.027 |
| −0.216 | 0.626 | 47.027 |
| 1.585 | −0.238 | 47.027 |
| −0.206 | 0.693 | 47.027 |
| 2.73 | −0.964 | 47.027 |
| 2.365 | −1.815 | 47.027 |
| 3.508 | −1.615 | 47.027 |
| 1.692 | −0.927 | 47.027 |
| 0.852 | −0.154 | 47.027 |
| −0.157 | 0.586 | 47.027 |
| 0.713 | 0.237 | 47.027 |
| −0.229 | 0.651 | 47.027 |
| 2.153 | −0.576 | 47.027 |
| 2.631 | −2.319 | 47.027 |
| −0.169 | 0.693 | 47.027 |
| 3.099 | −1.247 | 47.027 |
| 2.119 | −1.445 | 47.027 |
| 0.431 | 0.17 | 47.027 |
| 4.543 | −3.341 | 47.027 |
| 3.057 | −3.959 | 47.027 |
| 2.834 | −2.846 | 47.027 |
| 3.968 | −2.141 | 47.027 |
| 4.384 | −2.858 | 47.027 |
| 3.073 | −4.633 | 47.027 |
| 4.603 | −3.684 | 47.027 |
| 2.998 | −3.506 | 47.027 |
| 2.706 | −2.492 | 47.027 |
| 3.637 | −1.747 | 47.027 |
| 4.498 | −3.175 | 47.027 |
| 3.072 | −4.186 | 47.027 |
| 3.867 | −2.01 | 47.027 |
| 2.899 | −3.063 | 47.027 |
| 4.315 | −2.707 | 47.027 |
| 3.061 | −4.855 | 47.027 |
| 4.578 | −3.511 | 47.027 |
| 3.033 | −3.732 | 47.027 |
| 4.155 | −2.415 | 47.027 |
| 2.773 | −2.668 | 47.027 |
| 4.065 | −2.276 | 47.027 |
| 4.444 | −3.011 | 47.027 |
| 3.077 | −4.412 | 47.027 |
| 2.953 | −3.283 | 47.027 |
| 3.761 | −1.883 | 47.027 |
| 4.239 | −2.559 | 47.027 |
| 3.042 | −5.075 | 47.027 |
| 3.415 | −6.649 | 47.027 |
| 4.622 | −4.198 | 47.027 |
| 3.17 | −6.623 | 47.027 |
| 4.492 | −5.017 | 47.027 |
| 2.98 | −6.463 | 47.027 |
| 4.223 | −5.743 | 47.027 |
| 2.912 | −6.187 | 47.027 |
| 3.865 | −6.321 | 47.027 |
| 2.943 | −5.79 | 47.027 |
| 3.583 | −6.579 | 47.027 |
| 3.043 | −6.542 | 47.027 |
| 3.315 | −6.658 | 47.027 |
| 3.082 | −6.574 | 47.027 |

TABLE 1-continued

The coordinate values given below provide the preferred nominal profile envelope.

| X | Y | Z |
|---|---|---|
| 4.394 | −5.332 | 47.027 |
| 2.937 | −6.363 | 47.027 |
| 4.592 | −4.529 | 47.027 |
| 4.083 | −6.007 | 47.027 |
| 2.914 | −6.068 | 47.027 |
| 3.753 | −6.444 | 47.027 |
| 3.015 | −5.296 | 47.027 |
| 3.464 | −6.635 | 47.027 |
| 4.625 | −4.032 | 47.027 |
| 3.217 | −6.64 | 47.027 |
| 3.009 | −6.505 | 47.027 |
| 4.285 | −5.608 | 47.027 |
| 2.915 | −6.246 | 47.027 |
| 3.917 | −6.256 | 47.027 |
| 2.931 | −5.882 | 47.027 |
| 3.638 | −6.542 | 47.027 |
| 3.365 | −6.656 | 47.027 |
| 4.446 | −5.176 | 47.027 |
| 4.611 | −4.364 | 47.027 |
| 3.124 | −6.601 | 47.027 |
| 2.957 | −6.418 | 47.027 |
| 4.156 | −5.877 | 47.027 |
| 2.912 | −6.127 | 47.027 |
| 3.811 | −6.384 | 47.027 |
| 2.979 | −5.543 | 47.027 |
| 3.525 | −6.611 | 47.027 |
| 4.619 | −3.858 | 47.027 |
| 3.265 | −6.652 | 47.027 |
| 4.565 | −4.693 | 47.027 |
| 4.342 | −5.471 | 47.027 |
| 2.924 | −6.305 | 47.027 |
| 4.003 | −6.134 | 47.027 |
| 2.921 | −5.975 | 47.027 |
| 3.691 | −6.501 | 47.027 |
| 4.532 | −4.856 | 47.027 |
| 1.132 | −0.501 | 45.697 |
| 0.166 | 0.263 | 45.697 |
| 0.163 | 0.427 | 45.697 |
| −0.214 | 0.532 | 45.697 |
| 1.772 | −0.451 | 45.697 |
| −0.198 | 0.595 | 45.697 |
| 2.835 | −1.149 | 45.697 |
| 2.252 | −1.807 | 45.697 |
| 1.599 | −0.957 | 45.697 |
| 3.283 | −1.519 | 45.697 |
| 0.8 | −0.218 | 45.697 |
| −0.159 | 0.492 | 45.697 |
| 0.812 | 0.084 | 45.697 |
| 2.509 | −2.282 | 45.697 |
| 3.15 | −1.402 | 45.697 |
| 2.012 | −1.453 | 45.697 |
| 1.292 | −0.648 | 45.697 |
| 0.4 | 0.093 | 45.697 |
| −0.163 | 0.595 | 45.697 |
| 1.134 | −0.09 | 45.697 |
| −0.204 | 0.523 | 45.697 |
| 1.455 | −0.268 | 45.697 |
| −0.213 | 0.585 | 45.697 |
| 2.652 | −1.015 | 45.697 |
| 2.344 | −1.963 | 45.697 |
| −0.224 | 0.557 | 45.697 |
| 3.413 | −1.641 | 45.697 |
| 1.744 | −1.119 | 45.697 |
| 0.968 | −0.358 | 45.697 |
| −0.07 | 0.43 | 45.697 |
| 0.488 | 0.257 | 45.697 |
| −0.221 | 0.544 | 45.697 |
| 2.086 | −0.64 | 45.697 |
| 2.582 | −2.445 | 45.697 |
| −0.18 | 0.599 | 45.697 |
| −0.222 | 0.57 | 45.697 |
| 3.013 | −1.289 | 45.697 |
| 2.136 | −1.627 | 45.697 |
| 2.277 | −0.761 | 45.697 |
| 1.448 | −0.8 | 45.697 |

TABLE 1-continued

The coordinate values given below provide the preferred nominal profile envelope.

| X | Y | Z |
|---|---|---|
| 0.63 | −0.083 | 45.697 |
| −0.181 | 0.508 | 45.697 |
| 2.466 | −0.886 | 45.697 |
| 2.429 | −2.121 | 45.697 |
| 1.881 | −1.283 | 45.697 |
| 3.841 | −2.122 | 45.697 |
| 4.209 | −2.726 | 45.697 |
| 2.949 | −4.477 | 45.697 |
| 4.43 | −3.405 | 45.697 |
| 2.89 | −3.518 | 45.697 |
| 2.648 | −2.612 | 45.697 |
| 3.538 | −1.767 | 45.697 |
| 4.005 | −2.356 | 45.697 |
| 2.899 | −5.109 | 45.697 |
| 4.399 | −3.265 | 45.697 |
| 4.317 | −2.987 | 45.697 |
| 2.947 | −4.08 | 45.697 |
| 4.469 | −3.689 | 45.697 |
| 2.814 | −3.146 | 45.697 |
| 3.752 | −2.009 | 45.697 |
| 4.147 | −2.6 | 45.697 |
| 2.939 | −4.687 | 45.697 |
| 2.916 | −3.705 | 45.697 |
| 2.708 | −2.781 | 45.697 |
| 3.925 | −2.237 | 45.697 |
| 4.266 | −2.855 | 45.697 |
| 2.952 | −4.267 | 45.697 |
| 4.453 | −3.547 | 45.697 |
| 2.856 | −3.332 | 45.697 |
| 3.658 | −1.899 | 45.697 |
| 4.079 | −2.477 | 45.697 |
| 2.922 | −4.898 | 45.697 |
| 4.361 | −3.125 | 45.697 |
| 2.935 | −3.892 | 45.697 |
| 4.478 | −3.832 | 45.697 |
| 2.765 | −2.962 | 45.697 |
| 3.895 | −5.91 | 45.697 |
| 2.835 | −5.581 | 45.697 |
| 3.579 | −6.291 | 45.697 |
| 3.288 | −6.451 | 45.697 |
| 4.475 | −4.137 | 45.697 |
| 3.008 | −6.404 | 45.697 |
| 4.335 | −4.925 | 45.697 |
| 2.848 | −6.229 | 45.697 |
| 4.081 | −5.579 | 45.697 |
| 2.804 | −5.914 | 45.697 |
| 3.746 | −6.116 | 45.697 |
| 3.463 | −6.378 | 45.697 |
| 3.173 | −6.457 | 45.697 |
| 4.44 | −4.457 | 45.697 |
| 2.93 | −6.348 | 45.697 |
| 4.233 | −5.23 | 45.697 |
| 2.815 | −6.118 | 45.697 |
| 3.961 | −5.802 | 45.697 |
| 2.819 | −5.713 | 45.697 |
| 3.638 | −6.236 | 45.697 |
| 3.349 | −6.434 | 45.697 |
| 4.48 | −3.976 | 45.697 |
| 3.061 | −6.429 | 45.697 |
| 4.376 | −4.771 | 45.697 |
| 2.87 | −6.272 | 45.697 |
| 4.136 | −5.464 | 45.697 |
| 2.803 | −5.982 | 45.697 |
| 3.823 | −6.015 | 45.697 |
| 2.868 | −5.345 | 45.697 |
| 3.516 | −6.342 | 45.697 |
| 3.23 | −6.458 | 45.697 |
| 4.461 | −4.298 | 45.697 |
| 2.967 | −6.378 | 45.697 |
| 4.287 | −5.078 | 45.697 |
| 2.831 | −6.184 | 45.697 |
| 4.023 | −5.691 | 45.697 |
| 2.807 | −5.846 | 45.697 |
| 3.408 | −6.409 | 45.697 |
| 3.116 | −6.447 | 45.697 |

TABLE 1-continued

The coordinate values given below provide the preferred nominal profile envelope.

| X | Y | Z |
|---|---|---|
| 4.411 | −4.615 | 45.697 |
| 2.898 | −6.312 | 45.697 |
| 4.186 | −5.348 | 45.697 |
| 2.806 | −6.05 | 45.697 |
| 3.693 | −6.177 | 45.697 |
| 2.725 | −1.174 | 44.367 |
| 2.139 | −1.813 | 44.367 |
| 0.15 | 0.178 | 44.367 |
| 0.753 | −0.287 | 44.367 |
| 2.027 | −1.64 | 44.367 |
| −0.211 | 0.438 | 44.367 |
| 0.778 | 0.004 | 44.367 |
| 1.395 | −0.337 | 44.367 |
| 2.187 | −0.808 | 44.367 |
| 2.39 | −2.271 | 44.367 |
| 0.911 | −0.42 | 44.367 |
| 3.029 | −1.411 | 44.367 |
| 1.367 | −0.845 | 44.367 |
| −0.19 | 0.498 | 44.367 |
| 0.373 | 0.013 | 44.367 |
| −0.157 | 0.497 | 44.367 |
| −0.202 | 0.429 | 44.367 |
| 2.548 | −1.048 | 44.367 |
| 1.511 | −0.996 | 44.367 |
| −0.205 | 0.489 | 44.367 |
| 3.285 | −1.636 | 44.367 |
| 2.228 | −1.963 | 44.367 |
| −0.181 | 0.413 | 44.367 |
| −0.075 | 0.339 | 44.367 |
| 0.468 | 0.17 | 44.367 |
| −0.216 | 0.45 | 44.367 |
| 2.003 | −0.693 | 44.367 |
| 2.462 | −2.429 | 44.367 |
| −0.173 | 0.501 | 44.367 |
| −0.215 | 0.475 | 44.367 |
| 2.897 | −1.305 | 44.367 |
| 2.312 | −2.115 | 44.367 |
| −0.16 | 0.398 | 44.367 |
| 0.591 | −0.156 | 44.367 |
| 1.087 | −0.165 | 44.367 |
| 1.651 | −1.152 | 44.367 |
| −0.217 | 0.463 | 44.367 |
| 2.369 | −0.926 | 44.367 |
| 3.159 | −1.522 | 44.367 |
| 1.782 | −1.31 | 44.367 |
| 1.219 | −0.699 | 44.367 |
| 1.067 | −0.558 | 44.367 |
| 0.156 | 0.335 | 44.367 |
| 1.908 | −1.472 | 44.367 |
| 1.7 | −0.512 | 44.367 |
| 3.408 | −1.756 | 44.367 |
| 2.771 | −3.457 | 44.367 |
| 3.865 | −2.312 | 44.367 |
| 4.174 | −2.918 | 44.367 |
| 2.833 | −4.002 | 44.367 |
| 2.693 | −3.099 | 44.367 |
| 2.528 | −2.589 | 44.367 |
| 3.617 | −1.983 | 44.367 |
| 4.006 | −2.547 | 44.367 |
| 4.254 | −3.18 | 44.367 |
| 2.799 | −3.639 | 44.367 |
| 2.588 | −2.751 | 44.367 |
| 3.787 | −2.199 | 44.367 |
| 4.124 | −2.792 | 44.367 |
| 2.839 | −4.183 | 44.367 |
| 2.644 | −2.924 | 44.367 |
| 2.736 | −3.277 | 44.367 |
| 3.525 | −1.88 | 44.367 |
| 3.939 | −2.429 | 44.367 |
| 4.217 | −3.048 | 44.367 |
| 2.82 | −3.82 | 44.367 |
| 3.704 | −2.09 | 44.367 |
| 4.068 | −2.669 | 44.367 |
| 2.838 | −4.386 | 44.367 |
| 4.203 | −4.777 | 44.367 |

TABLE 1-continued

The coordinate values given below provide the preferred nominal profile envelope.

| X | Y | Z |
|---|---|---|
| 2.733 | −6.028 | 44.367 |
| 3.936 | −5.448 | 44.367 |
| 2.697 | −5.758 | 44.367 |
| 3.582 | −5.971 | 44.367 |
| 2.791 | −4.994 | 44.367 |
| 3.31 | −6.196 | 44.367 |
| 2.829 | −4.589 | 44.367 |
| 4.325 | −3.587 | 44.367 |
| 3.031 | −6.254 | 44.367 |
| 4.303 | −4.325 | 44.367 |
| 2.809 | −6.144 | 44.367 |
| 4.106 | −5.069 | 44.367 |
| 2.705 | −5.922 | 44.367 |
| 3.797 | −5.688 | 44.367 |
| 2.711 | −5.576 | 44.367 |
| 3.472 | −6.081 | 44.367 |
| 2.813 | −4.791 | 44.367 |
| 3.197 | −6.243 | 44.367 |
| 4.338 | −3.865 | 44.367 |
| 2.924 | −6.222 | 44.367 |
| 4.243 | −4.628 | 44.367 |
| 2.753 | −6.07 | 44.367 |
| 2.76 | −5.221 | 44.367 |
| 3.998 | −5.324 | 44.367 |
| 3.362 | −6.165 | 44.367 |
| 4.308 | −3.45 | 44.367 |
| 3.086 | −6.259 | 44.367 |
| 4.322 | −4.172 | 44.367 |
| 2.844 | −6.175 | 44.367 |
| 3.633 | −5.913 | 44.367 |
| 4.157 | −4.925 | 44.367 |
| 2.716 | −5.976 | 44.367 |
| 3.869 | −5.57 | 44.367 |
| 2.699 | −5.703 | 44.367 |
| 3.529 | −6.027 | 44.367 |
| 2.699 | −5.868 | 44.367 |
| 3.254 | −6.223 | 44.367 |
| 4.335 | −3.726 | 44.367 |
| 2.977 | −6.242 | 44.367 |
| 4.276 | −4.477 | 44.367 |
| 2.778 | −6.109 | 44.367 |
| 2.696 | −5.813 | 44.367 |
| 4.054 | −5.197 | 44.367 |
| 2.727 | −5.448 | 44.367 |
| 3.718 | −5.803 | 44.367 |
| 3.412 | −6.13 | 44.367 |
| 4.285 | −3.314 | 44.367 |
| 3.142 | −6.255 | 44.367 |
| 4.334 | −4.019 | 44.367 |
| 2.883 | −6.2 | 44.367 |
| −0.206 | 0.342 | 43.037 |
| 0.891 | −0.157 | 43.037 |
| 1.824 | −1.522 | 43.037 |
| 2.268 | −0.963 | 43.037 |
| 2.239 | −2.197 | 43.037 |
| 3.031 | −1.522 | 43.037 |
| 1.705 | −1.364 | 43.037 |
| 1.021 | −0.632 | 43.037 |
| −0.183 | 0.4 | 43.037 |
| 0.14 | 0.088 | 43.037 |
| −0.199 | 0.333 | 43.037 |
| −0.151 | 0.399 | 43.037 |
| 2.044 | −1.849 | 43.037 |
| 1.309 | −0.913 | 43.037 |
| 3.273 | −1.741 | 43.037 |
| −0.198 | 0.392 | 43.037 |
| 1.447 | −1.06 | 43.037 |
| 0.546 | 0.032 | 43.037 |
| −0.211 | 0.354 | 43.037 |
| 0.563 | −0.238 | 43.037 |
| 2.325 | −2.376 | 43.037 |
| −0.208 | 0.379 | 43.037 |
| 1.167 | −0.77 | 43.037 |
| −0.172 | 0.313 | 43.037 |
| 0.353 | −0.073 | 43.037 |

TABLE 1-continued

The coordinate values given below provide the preferred nominal profile envelope.

| X | Y | Z |
|---|---|---|
| −0.186 | 0.322 | 43.037 |
| 1.235 | −0.348 | 43.037 |
| −0.211 | 0.367 | 43.037 |
| 2.441 | −1.078 | 43.037 |
| 2.145 | −2.021 | 43.037 |
| 2.093 | −0.852 | 43.037 |
| 3.153 | −1.629 | 43.037 |
| 1.58 | −1.211 | 43.037 |
| −0.158 | 0.303 | 43.037 |
| 0.199 | 0.217 | 43.037 |
| 0.871 | −0.497 | 43.037 |
| 2.905 | −1.419 | 43.037 |
| 1.577 | −0.543 | 43.037 |
| 2.403 | −2.558 | 43.037 |
| 0.719 | −0.366 | 43.037 |
| 1.916 | −0.743 | 43.037 |
| 1.937 | −1.683 | 43.037 |
| −0.076 | 0.245 | 43.037 |
| 2.61 | −1.196 | 43.037 |
| −0.167 | 0.403 | 43.037 |
| 2.777 | −1.319 | 43.037 |
| 2.578 | −3.078 | 43.037 |
| 3.923 | −2.606 | 43.037 |
| 2.723 | −4.496 | 43.037 |
| 4.139 | −3.224 | 43.037 |
| 2.685 | −3.593 | 43.037 |
| 2.474 | −2.744 | 43.037 |
| 4.072 | −2.969 | 43.037 |
| 2.621 | −3.249 | 43.037 |
| 3.723 | −2.268 | 43.037 |
| 3.795 | −2.379 | 43.037 |
| 4.028 | −2.845 | 43.037 |
| 3.478 | −1.956 | 43.037 |
| 3.862 | −2.491 | 43.037 |
| 4.109 | −3.096 | 43.037 |
| 2.707 | −3.765 | 43.037 |
| 2.529 | −2.91 | 43.037 |
| 2.73 | −4.109 | 43.037 |
| 3.645 | −2.161 | 43.037 |
| 3.564 | −2.057 | 43.037 |
| 3.979 | −2.724 | 43.037 |
| 2.73 | −4.302 | 43.037 |
| 2.656 | −3.42 | 43.037 |
| 3.388 | −1.858 | 43.037 |
| 2.722 | −3.937 | 43.037 |
| 4.191 | −3.619 | 43.037 |
| 2.896 | −6.05 | 43.037 |
| 4.142 | −4.34 | 43.037 |
| 2.695 | −5.941 | 43.037 |
| 3.933 | −5.032 | 43.037 |
| 2.602 | −5.717 | 43.037 |
| 4.193 | −3.9 | 43.037 |
| 3.607 | −5.611 | 43.037 |
| 2.616 | −5.397 | 43.037 |
| 3.31 | −5.923 | 43.037 |
| 2.728 | −5.971 | 43.037 |
| 3.055 | −6.049 | 43.037 |
| 4.074 | −4.629 | 43.037 |
| 2.6 | −5.56 | 43.037 |
| 2.804 | −6.017 | 43.037 |
| 2.644 | −5.868 | 43.037 |
| 2.598 | −5.612 | 43.037 |
| 3.878 | −5.153 | 43.037 |
| 3.819 | −5.272 | 43.037 |
| 2.658 | −5.099 | 43.037 |
| 2.688 | −4.882 | 43.037 |
| 3.161 | −6.014 | 43.037 |
| 3.475 | −5.771 | 43.037 |
| 2.61 | −5.769 | 43.037 |
| 3.684 | −5.502 | 43.037 |
| 2.606 | −5.478 | 43.037 |
| 3.368 | −5.876 | 43.037 |
| 2.709 | −4.689 | 43.037 |
| 3.213 | −5.988 | 43.037 |
| 3.107 | −6.035 | 43.037 |

TABLE 1-continued

The coordinate values given below provide the preferred nominal profile envelope.

| X | Y | Z |
|---|---|---|
| 3.423 | −5.825 | 43.037 |
| 4.196 | −3.752 | 43.037 |
| 2.845 | −6.035 | 43.037 |
| 4.18 | −3.486 | 43.037 |
| 4.111 | −4.485 | 43.037 |
| 2.667 | −5.906 | 43.037 |
| 2.949 | −6.058 | 43.037 |
| 2.599 | −5.664 | 43.037 |
| 3.524 | −5.716 | 43.037 |
| 2.627 | −5.316 | 43.037 |
| 4.166 | −4.194 | 43.037 |
| 3.263 | −5.957 | 43.037 |
| 4.163 | −3.354 | 43.037 |
| 3.002 | −6.057 | 43.037 |
| 4.183 | −4.047 | 43.037 |
| 2.764 | −5.996 | 43.037 |
| 3.982 | −4.909 | 43.037 |
| 4.031 | −4.77 | 43.037 |
| 2.624 | −5.819 | 43.037 |
| 3.754 | −5.389 | 43.037 |
| 2.231 | −1.042 | 41.707 |
| −0.079 | 0.153 | 41.707 |
| 0.186 | 0.128 | 41.707 |
| −0.202 | 0.248 | 41.707 |
| 1.492 | −0.595 | 41.707 |
| 1.814 | −0.784 | 41.707 |
| −0.176 | 0.303 | 41.707 |
| 2.29 | −2.548 | 41.707 |
| 0.128 | 0.001 | 41.707 |
| 1.842 | −1.713 | 41.707 |
| 1.109 | −0.831 | 41.707 |
| 1.244 | −0.969 | 41.707 |
| 2.13 | −2.204 | 41.707 |
| −0.196 | 0.238 | 41.707 |
| −0.171 | 0.218 | 41.707 |
| 0.842 | −0.229 | 41.707 |
| 2.435 | −1.178 | 41.707 |
| −0.204 | 0.272 | 41.707 |
| 0.332 | −0.155 | 41.707 |
| 2.998 | −1.605 | 41.707 |
| 1.621 | −1.406 | 41.707 |
| −0.19 | 0.295 | 41.707 |
| −0.184 | .227 | 41.707 |
| 3.113 | −1.707 | 41.707 |
| 0.532 | −0.315 | 41.707 |
| 2.635 | −1.319 | 41.707 |
| −.2 | .283 | 41.707 |
| 1.944 | −1.871 | 41.707 |
| 3.225 | −1.815 | 41.707 |
| 1.375 | −1.111 | 41.707 |
| 2.04 | −2.036 | 41.707 |
| 0.681 | −0.439 | 41.707 |
| 1.168 | −0.411 | 41.707 |
| −0.157 | 0.209 | 41.707 |
| 0.515 | −0.049 | 41.707 |
| −0.205 | 0.26 | 41.707 |
| 1.502 | −1.258 | 41.707 |
| 2.024 | −0.911 | 41.707 |
| −0.16 | 0.305 | 41.707 |
| 2.879 | −1.506 | 41.707 |
| 1.734 | −1.557 | 41.707 |
| 0.827 | −0.566 | 41.707 |
| −0.145 | 0.301 | 41.707 |
| 2.758 | −1.411 | 41.707 |
| 2.213 | −2.375 | 41.707 |
| 0.969 | −0.697 | 41.707 |
| 4.013 | −3.227 | 41.707 |
| 3.868 | −2.739 | 41.707 |
| 4.033 | −3.352 | 41.707 |
| 3.314 | −1.905 | 41.707 |
| 3.987 | −3.103 | 41.707 |
| 3.699 | −2.406 | 41.707 |
| 3.559 | −2.198 | 41.707 |
| 3.761 | −2.514 | 41.707 |
| 3.954 | −2.98 | 41.707 |

TABLE 1-continued

The coordinate values given below provide the preferred nominal profile envelope.

| X | Y | Z |
|---|---|---|
| 3.481 | −2.097 | 41.707 |
| 3.632 | −2.302 | 41.707 |
| 3.914 | −2.859 | 41.707 |
| 3.817 | −2.625 | 41.707 |
| 3.399 | −2 | 41.707 |
| 4.035 | −4.031 | 41.707 |
| 3.871 | −4.722 | 41.707 |
| 4.048 | −3.89 | 41.707 |
| 3.635 | −5.223 | 41.707 |
| 3.956 | −4.45 | 41.707 |
| 4.053 | −3.605 | 41.707 |
| 3.916 | −4.587 | 41.707 |
| 3.576 | −5.318 | 41.707 |
| 3.69 | −5.127 | 41.707 |
| 3.989 | −4.312 | 41.707 |
| 4.046 | −3.478 | 41.707 |
| 4.015 | −4.172 | 41.707 |
| 3.788 | −4.928 | 41.707 |
| 3.831 | −4.826 | 41.707 |
| 4.055 | −3.748 | 41.707 |
| 3.741 | −5.028 | 41.707 |
| 2.625 | −4.223 | 41.707 |
| 2.621 | −4.409 | 41.707 |
| 2.542 | −3.373 | 41.707 |
| 2.359 | −2.726 | 41.707 |
| 2.613 | −3.871 | 41.707 |
| 2.596 | −3.705 | 41.707 |
| 2.573 | −3.539 | 41.707 |
| 2.413 | −2.884 | 41.707 |
| 2.462 | −3.045 | 41.707 |
| 2.622 | −4.037 | 41.707 |
| 2.506 | −3.208 | 41.707 |
| 2.608 | −4.595 | 41.707 |
| 3.177 | −5.746 | 41.707 |
| 2.899 | −5.856 | 41.707 |
| 2.95 | −5.849 | 41.707 |
| 2.678 | −5.805 | 41.707 |
| 2.539 | −5.648 | 41.707 |
| 3.292 | −5.655 | 41.707 |
| 3.344 | −5.605 | 41.707 |
| 2.589 | −4.782 | 41.707 |
| 3.049 | −5.818 | 41.707 |
| 2.51 | −5.434 | 41.707 |
| 2.798 | −5.851 | 41.707 |
| 2.518 | −5.564 | 41.707 |
| 3.442 | −5.498 | 41.707 |
| 2.522 | −5.277 | 41.707 |
| 2.757 | −5.84 | 41.707 |
| 2.51 | −5.477 | 41.707 |
| 2.716 | −5.825 | 41.707 |
| 2.581 | −5.723 | 41.707 |
| 2.557 | −5.687 | 41.707 |
| 3.394 | −5.553 | 41.707 |
| 2.56 | −4.99 | 41.707 |
| 2.512 | −5.52 | 41.707 |
| 3.115 | −5.785 | 41.707 |
| 2.609 | −5.755 | 41.707 |
| 2.642 | −5.782 | 41.707 |
| 2.848 | −5.857 | 41.707 |
| 2.526 | −5.607 | 41.707 |
| 2.531 | −5.199 | 41.707 |
| 2.514 | −5.356 | 41.707 |
| 3 | −5.836 | 41.707 |
| 3.511 | −5.409 | 41.707 |
| 3.236 | −5.703 | 41.707 |
| 1.849 | −1.884 | 40.377 |
| 1.306 | −1.155 | 40.377 |
| 3.163 | −1.876 | 40.377 |
| 1.181 | −1.018 | 40.377 |
| 0.503 | −0.388 | 40.377 |
| 1.752 | −1.732 | 40.377 |
| −0.192 | 0.144 | 40.377 |
| 1.107 | −0.477 | 40.377 |
| 0.798 | −0.304 | 40.377 |
| −0.197 | 0.177 | 40.377 |

TABLE 1-continued

The coordinate values given below provide the preferred nominal profile envelope.

| X | Y | Z |
|---|---|---|
| 2.121 | −1.074 | 40.377 |
| 2.029 | −2.202 | 40.377 |
| −0.138 | 0.203 | 40.377 |
| 1.54 | −1.438 | 40.377 |
| 0.116 | −0.085 | 40.377 |
| 2.627 | −1.418 | 40.377 |
| 1.416 | −0.653 | 40.377 |
| 2.25 | −2.701 | 40.377 |
| −0.182 | 0.199 | 40.377 |
| 0.176 | 0.038 | 40.377 |
| 1.722 | −0.831 | 40.377 |
| 2.508 | −1.333 | 40.377 |
| −0.17 | 0.123 | 40.377 |
| 0.644 | −0.508 | 40.377 |
| 0.487 | −0.132 | 40.377 |
| −0.198 | 0.166 | 40.377 |
| 1.427 | −1.296 | 40.377 |
| 1.923 | −0.951 | 40.377 |
| 2.109 | −2.365 | 40.377 |
| −0.153 | 0.207 | 40.377 |
| 1.649 | −1.583 | 40.377 |
| −0.157 | 0.114 | 40.377 |
| 1.052 | −0.885 | 40.377 |
| 0.311 | −0.234 | 40.377 |
| 0.783 | −0.63 | 40.377 |
| 3.078 | −1.793 | 40.377 |
| 2.743 | −1.507 | 40.377 |
| −0.182 | 0.132 | 40.377 |
| −0.193 | 0.188 | 40.377 |
| 2.316 | −1.201 | 40.377 |
| 1.942 | −2.041 | 40.377 |
| −0.082 | 0.061 | 40.377 |
| 2.969 | −1.693 | 40.377 |
| 2.857 | −1.598 | 40.377 |
| 0.919 | −0.756 | 40.377 |
| −0.197 | 0.154 | 40.377 |
| −0.168 | 0.206 | 40.377 |
| 2.183 | −2.532 | 40.377 |
| 3.544 | −2.343 | 40.377 |
| 3.838 | −2.999 | 40.377 |
| 2.492 | −4.671 | 40.377 |
| 2.503 | −3.796 | 40.377 |
| 2.352 | −3.007 | 40.377 |
| 3.803 | −2.882 | 40.377 |
| 3.327 | −2.054 | 40.377 |
| 3.663 | −2.547 | 40.377 |
| 3.476 | −2.244 | 40.377 |
| 2.461 | −3.479 | 40.377 |
| 3.913 | −3.475 | 40.377 |
| 3.762 | −2.767 | 40.377 |
| 3.404 | −2.148 | 40.377 |
| 3.888 | −3.235 | 40.377 |
| 3.903 | −3.355 | 40.377 |
| 2.394 | −3.163 | 40.377 |
| 2.514 | −3.955 | 40.377 |
| 3.715 | −2.654 | 40.377 |
| 3.606 | −2.444 | 40.377 |
| 2.508 | −4.492 | 40.377 |
| 2.485 | −3.638 | 40.377 |
| 2.519 | −4.134 | 40.377 |
| 2.304 | −2.853 | 40.377 |
| 3.247 | −1.963 | 40.377 |
| 3.866 | −3.116 | 40.377 |
| 2.517 | −4.313 | 40.377 |
| 2.431 | −3.32 | 40.377 |
| 3.915 | −3.718 | 40.377 |
| 2.482 | −5.498 | 40.377 |
| 3.561 | −4.984 | 40.377 |
| 2.435 | −5.298 | 40.377 |
| 3.268 | −5.392 | 40.377 |
| 2.675 | −5.642 | 40.377 |
| 2.993 | −5.603 | 40.377 |
| 3.826 | −4.313 | 40.377 |
| 2.756 | −5.656 | 40.377 |
| 3.876 | −4.081 | 40.377 |

TABLE 1-continued

The coordinate values given below provide the preferred nominal profile envelope.

| X | Y | Z |
|---|---|---|
| 2.564 | −5.59 | 40.377 |
| 2.504 | −5.533 | 40.377 |
| 2.44 | −5.147 | 40.377 |
| 3.617 | −4.877 | 40.377 |
| 3.167 | −5.487 | 40.377 |
| 3.853 | −4.197 | 40.377 |
| 2.901 | −5.639 | 40.377 |
| 2.438 | −5.34 | 40.377 |
| 3.315 | −5.341 | 40.377 |
| 2.532 | −5.564 | 40.377 |
| 3.668 | −4.768 | 40.377 |
| 2.469 | −4.871 | 40.377 |
| 2.443 | −5.381 | 40.377 |
| 3.054 | −5.569 | 40.377 |
| 2.805 | −5.656 | 40.377 |
| 3.36 | −5.287 | 40.377 |
| 3.894 | −3.961 | 40.377 |
| 2.599 | −5.611 | 40.377 |
| 3.757 | −4.542 | 40.377 |
| 2.464 | −5.461 | 40.377 |
| 2.446 | −5.072 | 40.377 |
| 3.917 | −3.597 | 40.377 |
| 2.435 | −5.223 | 40.377 |
| 3.112 | −5.53 | 40.377 |
| 2.451 | −5.421 | 40.377 |
| 3.219 | −5.441 | 40.377 |
| 3.907 | −3.84 | 40.377 |
| 2.948 | −5.623 | 40.377 |
| 3.433 | −5.189 | 40.377 |
| 3.794 | −4.429 | 40.377 |
| 2.715 | −5.651 | 40.377 |
| 2.854 | −5.65 | 40.377 |
| 3.5 | −5.088 | 40.377 |
| 2.637 | −5.628 | 40.377 |
| 3.715 | −4.656 | 40.377 |
| 2.019 | −1.111 | 39.047 |
| 1.835 | −2.024 | 39.047 |
| −0.132 | 0.106 | 39.047 |
| 2.807 | −1.668 | 39.047 |
| 1.343 | −1.318 | 39.047 |
| 0.989 | −0.929 | 39.047 |
| 0.735 | −0.686 | 39.047 |
| 1.919 | −2.177 | 39.047 |
| 1.653 | −1.731 | 39.047 |
| −0.086 | −0.03 | 39.047 |
| −0.188 | 0.051 | 39.047 |
| 0.288 | −0.31 | 39.047 |
| 2.07 | −2.491 | 39.047 |
| −0.174 | 0.103 | 39.047 |
| 2.39 | −1.354 | 39.047 |
| 1.111 | −1.055 | 39.047 |
| 3.022 | −1.86 | 39.047 |
| −0.169 | 0.029 | 39.047 |
| 0.469 | −0.456 | 39.047 |
| 1.451 | −1.453 | 39.047 |
| 0.462 | −0.217 | 39.047 |
| −0.146 | 0.11 | 39.047 |
| 0.757 | −0.381 | 39.047 |
| 1.829 | −0.995 | 39.047 |
| −0.157 | 0.021 | 39.047 |
| 0.102 | −0.168 | 39.047 |
| −0.18 | 0.039 | 39.047 |
| 2.671 | −1.559 | 39.047 |
| −0.19 | 0.083 | 39.047 |
| 2.136 | −2.653 | 39.047 |
| −0.185 | 0.093 | 39.047 |
| 1.638 | −0.882 | 39.047 |
| 2.206 | −1.231 | 39.047 |
| 1.746 | −1.875 | 39.047 |
| 2.939 | −1.783 | 39.047 |
| 1.229 | −1.185 | 39.047 |
| 0.604 | −0.57 | 39.047 |
| −0.121 | −0.004 | 39.047 |
| 0.166 | −0.054 | 39.047 |
| −0.192 | 0.061 | 39.047 |

TABLE 1-continued

| The coordinate values given below provide the preferred nominal profile envelope. | | |
|---|---|---|
| X | Y | Z |
| 1.346 | −0.713 | 39.047 |
| −0.16 | 0.109 | 39.047 |
| −0.192 | 0.072 | 39.047 |
| 1.997 | −2.332 | 39.047 |
| 2.532 | −1.455 | 39.047 |
| 3.103 | −1.941 | 39.047 |
| 0.864 | −0.806 | 39.047 |
| 1.554 | −1.59 | 39.047 |
| 1.052 | −0.546 | 39.047 |
| 3.257 | −2.112 | 39.047 |
| 2.404 | −4.53 | 39.047 |
| 3.568 | −2.587 | 39.047 |
| 3.746 | −3.137 | 39.047 |
| 2.388 | −3.668 | 39.047 |
| 3.396 | −2.295 | 39.047 |
| 2.389 | −4.723 | 39.047 |
| 3.658 | −2.801 | 39.047 |
| 2.196 | −2.818 | 39.047 |
| 3.774 | −3.366 | 39.047 |
| 2.405 | −3.842 | 39.047 |
| 3.78 | −3.482 | 39.047 |
| 3.181 | −2.024 | 39.047 |
| 3.516 | −2.487 | 39.047 |
| 2.413 | −4.358 | 39.047 |
| 3.723 | −3.024 | 39.047 |
| 2.364 | −3.495 | 39.047 |
| 2.248 | −2.985 | 39.047 |
| 3.329 | −2.203 | 39.047 |
| 2.294 | −3.154 | 39.047 |
| 3.616 | −2.693 | 39.047 |
| 2.414 | −4.013 | 39.047 |
| 2.417 | −4.185 | 39.047 |
| 3.763 | −3.251 | 39.047 |
| 2.333 | −3.324 | 39.047 |
| 3.458 | −2.39 | 39.047 |
| 3.694 | −2.912 | 39.047 |
| 3.726 | −4.054 | 39.047 |
| 3.178 | −5.203 | 39.047 |
| 3.566 | −4.573 | 39.047 |
| 3.325 | −5.019 | 39.047 |
| 2.371 | −4.988 | 39.047 |
| 3.481 | −4.758 | 39.047 |
| 2.372 | −5.132 | 39.047 |
| 3.082 | −5.294 | 39.047 |
| 2.918 | −5.403 | 39.047 |
| 2.831 | −5.437 | 39.047 |
| 3.773 | −3.714 | 39.047 |
| 3.671 | −4.274 | 39.047 |
| 2.447 | −5.352 | 39.047 |
| 2.376 | −5.171 | 39.047 |
| 3.525 | −4.666 | 39.047 |
| 2.692 | −5.456 | 39.047 |
| 3.222 | −5.153 | 39.047 |
| 2.975 | −5.372 | 39.047 |
| 2.507 | −5.402 | 39.047 |
| 3.746 | −3.943 | 39.047 |
| 2.542 | −5.421 | 39.047 |
| 2.739 | −5.455 | 39.047 |
| 3.637 | −4.382 | 39.047 |
| 2.785 | −5.449 | 39.047 |
| 3.03 | −5.335 | 39.047 |
| 3.131 | −5.25 | 39.047 |
| 2.875 | −5.422 | 39.047 |
| 3.779 | −3.598 | 39.047 |
| 2.654 | −5.453 | 39.047 |
| 2.578 | −5.435 | 39.047 |
| 3.701 | −4.165 | 39.047 |
| 3.604 | −4.478 | 39.047 |
| 2.382 | −5.21 | 39.047 |
| 2.406 | −5.285 | 39.047 |
| 3.264 | −5.101 | 39.047 |
| 2.375 | −4.916 | 39.047 |
| 3.381 | −4.934 | 39.047 |
| 3.762 | −3.829 | 39.047 |
| 2.369 | −5.06 | 39.047 |

TABLE 1-continued

| The coordinate values given below provide the preferred nominal profile envelope. | | |
|---|---|---|
| X | Y | Z |
| 2.476 | −5.38 | 39.047 |
| 2.424 | −5.32 | 39.047 |
| 3.433 | −4.847 | 39.047 |
| 2.616 | −5.446 | 39.047 |
| 2.392 | −5.248 | 39.047 |

It will also be appreciated that the airfoil disclosed in Table 1 may be scaled up or down geometrically for use in similar turbine designs. Consequently, the coordinate values set forth in Table 1 may be scaled upwardly or downwardly such that the airfoil section shape remains unchanged. A scaled version of the coordinates in Table I would be represented by X, Y and, optionally, Z coordinate values (after the Z values have been converted to inches) multiplied or divided by the same constant or number.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

While the invention has been described in connection with what is presently considered to be the most practical and preferred embodiment, it is to be understood that the invention is not to be limited to the disclosed embodiment. On the contrary, is intended to cover various modifications and equivalent arrangements included within the spirit and scope of the appended claims.

What is claimed is:

1. An article of manufacture, the article having a nominal profile substantially in accordance with Cartesian coordinate values of X, Y and Z set forth in table 1, and wherein X and Y are distances in inches which, when connected by smooth continuing arcs, define airfoil profile sections at each distance Z in inches, the profile sections at the Z distances being joined smoothly with one another to form a complete airfoil shape.

2. An article of manufacture according to claim 1, wherein the article comprises an airfoil.

3. An article of manufacture according to claim 2, wherein said article shape lies in an envelope within ±0.100 inches in a direction normal to any article surface location.

4. An article of manufacture according to claim 1, wherein the article comprises a turbine nozzle.

5. An article of manufacture according to claim 4, wherein the turbine nozzle comprises a third stage turbine nozzle.

6. A turbine comprising at least one turbine nozzle, each said turbine nozzle including an airfoil having an airfoil shape, said airfoil having a nominal profile substantially in accordance with Cartesian coordinate values of X, Y and Z set forth in table 1, wherein X and Y are distances in inches which, when connected by smooth continuing arcs, define the airfoil profile sections at each distance Z in inches, the profile sections at the Z distances being joined smoothly with one another to form a complete airfoil shape.

7. A turbine nozzle according to claim 6 wherein the compressor wheel rotor blades.

8. A turbine comprising at least one turbine nozzle, each said turbine nozzle including an airfoil having an uncoated nominal airfoil profile substantially in accordance with Cartesian coordinate values of X, Y and Z set forth in table 1, wherein X and Y are distances in inches which, when connected by smooth continuing arcs, define airfoil profile sections at each distance Z in inches, the profile sections at the Z distances being joined smoothly with one another to form a complete airfoil shape, the X and Y distances being scalable as a function of the same constant or number to provide a scaled-up or scaled-down rotor blade airfoil.

9. A turbine according to claim 8 wherein the turbine comprises a third stage of a turbine nozzle.

10. A compressor according to claim 8 wherein the compressor wheel has 66 rotor blades.

11. A compressor according to claim 8 wherein said airfoil shape lies in an envelope within ±0.100 inches in a direction normal to any airfoil surface location.

* * * * *